US006466896B1

(12) United States Patent
Kim

(10) Patent No.: US 6,466,896 B1
(45) Date of Patent: Oct. 15, 2002

(54) PERFORMANCE ANALYSIS METHOD OF CENTRIFUGAL IMPELLER

(75) Inventor: Jae-Won Kim, 100, Kalsan-Ri, Tangjong-Myon, Asan-City, Chungchongnam-Do 336-840 (KR)

(73) Assignees: Sun Moon University, Chungchongnam-Do (KR); Jae-Won Kim, Seoul (KR)

( * ) Notice: Subject to any disclaimer, the term of this patent is extended or adjusted under 35 U.S.C. 154(b) by 224 days.

(21) Appl. No.: 09/590,298

(22) Filed: Jun. 9, 2000

(30) Foreign Application Priority Data

Oct. 8, 1999 (KR) ..... 99-43459

(51) Int. Cl.[7] ..... G06F 15/00

(52) U.S. Cl. ..... 702/183; 702/41; 702/145; 702/147; 416/61

(58) Field of Search ..... 73/1.16, 1.37, 73/170.11, 170.15, 861, 861.35, 861.39, 861.69, 227, 195–196; 415/1, 233; 416/1, 61, 248, 183, 33, 44, 45; 702/47, 50, 48, 105, 108, 113, 114, 138, 140, 182, 183

(56) References Cited

U.S. PATENT DOCUMENTS 4,615,659 A * 10/1986 Sidransky ..... 416/183
6,260,004 B1 * 7/2001 Hays et al. ..... 702/183

* cited by examiner

*Primary Examiner*—Marc S. Hoff
*Assistant Examiner*—Sam H. Choi
(74) *Attorney, Agent, or Firm*—Bacon & Thomas, PLLC

(57) ABSTRACT

A performance analysis method for a centrifugal impeller adapter to simplify performance analysis of an impeller and to obtain an accurate calculation result in comparison with analysis by way of averaging the entire flow of the centrifugal impeller. The method for measuring a flow field at an impeller exit analyzes an exit flow angle, total pressure ratio and efficiency, to enable analysis of the performance of the manufactured centrifugal impeller, wherein the flow field of the centrifugal impeller at the impeller exit is dualized into a jet region flow field and a wake region flow field, by which each flow field is sought and averaged to obtain the flow field.

2 Claims, 2 Drawing Sheets

PERFORMANCE ANALYSIS METHOD OF CENTRIFUGAL IMPELLER

BACKGROUND OF THE INVENTION

FIELD OF THE INVENTION

The present invention relates to a performance analysis method, and more particularly to a performance analysis method of centrifugal impeller adapted to simply analyze the effect of centrifugal impeller.

Generally, rotating parts such as impeller and the like differ in performance thereof according to distribution of flow angle at blade exit, total pressure ratio, efficiency and the like.

Various physical quantity, design base of fluid machines such as impellers and the like, is obtained through three-dimensional flow analysis made on a base of certain turbulence state, through which performance is analyzed.

Among various impellers, a centrifugal impeller is composed of a disc-shaped base plate 50 and a plurality of blades 51 perpendicularly fixed to the base plate 50 and formed to have a certain curvature.

When the centrifugal impeller thus constructed is rotated, fluid is discharged from exit side (E) of the blade 51 bent at the predetermined curvature for blowing.

A centrifugal impeller manufactured in the above method according to a predetermined design dimensions is inspected for analysis of its performance, where an analyzed values thereof are generally exit flow angle, total pressure ratio, efficiency and the like.

At this time, the exit flow angle ($\alpha_{2m}$) which is a characteristic numerical value of the centrifugal impeller is defined by the following Formula 1, while, the total pressure ratio (PR) is obtained by Formula 2. The efficiency ($\eta_s$) is represented by formula 3.

Formula 1

$$\alpha_{2m} = \tan^{-1}\left(\frac{V_{u2m}}{V_{m2m}}\right)$$

$V_{u2m}$: absolute velocity in tangent direction at impeller exit side, $V_{u2m}=(1-\chi)V_{u2j}+\chi V_{u2w}$ $V_{m2m}$: absolute velocity in radial direction at impeller exit side, $$V_{m2m} = \frac{b - \sqrt{b^2 - 4ac}}{2a}$$

$$a = \frac{m}{\pi D_2 b_2} + \frac{r+1}{2r}$$

$$b = \frac{P_{2j}A_g}{\pi D_2 b_2} + \frac{m}{\pi D_2 b_2}[(1-x)V_{m2j} + xV_{m2w}$$

$$c = \frac{m}{\pi D_2 b_2}\left[R_{o2m} - \frac{r-1}{2r}V_{u2m}^2\right]$$

$$P_{2m} = \frac{P_{2j}A_g}{\pi D_2 b_2} + \frac{m}{\pi D_2 b_2}[(1-x)V_{m2j} + xV_{m2w} - V_{m2m}]$$

$$V_{2m} = (V_{m2m}^2 + V_{u2m}^2)^{1/2}$$

$$T_{2m} = T_{o2m} - \frac{r-1}{2rR}V_{2m}^2$$

$$\rho_{2m} = \frac{P_{2m}}{RT_{2m}}$$

-continued $$T_{o2m} = (1-x)T_{o2j} + xT_{o2w} + \frac{r-1}{rRm}(W_{df} + W_{rc} + W_{lk})$$

$$P_{o2m} = P_{2m}\left(\frac{T_{o2m}}{T_{2m}}\right)^{r/(r-1)}$$

Formula 2

$$PR = \frac{P_{o2m}}{P_{o1m}}$$

$P_{o2m}$: total pressure at impeller exit side $P_{o1m}$: total pressure at impeller entry side Formula 3

$$\eta_s = \frac{PR^{\frac{r-1}{r}} - 1}{\frac{T_{o2m}}{T_{o1m}} - 1}$$

where, variable values in the above Formulae 1, 2 and 3 are $\chi$: wake area mass ratio ($m_w$/m)

r: specific heat ratio $T_{o2m}$: temperature at impeller exit side $T_{o1m}$: temperature at impeller entry side $A_g$: impeller exit area excluding blade thickness m: mass flow P: pressure R: gas constant V : absolute velocity W: work ratio $D_2$: diameter at impeller exit $b_2$: exit width of impeller where, subscripts are 0: total condition 2: impeller exit 2m: mixed condition df: disc friction j: jet lk: leakage m: radial direction rc: recycling u: tangent direction Flow analysis utilizing Formulas such as above is obtained by substitution of numerical values to turbulence modeling defined in numerical expression relative to certain turbulence. At this time, a slip coefficient is introduced with a completely-mixed average flow speed relative to entire exit as standard while a manufactured impeller is activated to obtain an absolute exit flow speed. A flow angle against the absolute exit flow speed is then calculated to analyze the performance of the impeller.

However, there is a problem in the repeated performance analysis according to existing analysis method based on the completely-mixed average flow speed relative to the entire exit thus described in that the manufactured impeller has no optimum turbulence modeling to necessitate a plurality of turbulence modeling optimized to various parts of the impeller, complicating performance analysis work of impeller and marking it impossible to obtain an accurate result (characteristic numerical value) due to performance analysis by way of various turbulence modeling.

SUMMARY OF THE INVENTION

The present invention is disclosed to solve the aforementioned problems and it is an object of the present invention to provide a performance analysis method of centrifugal impeller adapted to simplify performance analysis of impeller and to obtain an accurate calculation result in comparison with analysis by way of averaging the entire flow of the centrifugal impeller.

In accordance with the object of the present invention, there is provided a performance analysis method of centrifugal impeller, the method for measuring a flow field at an impeller exit to analyze an exit flow angle, total pressure ratio and efficiency, thereby enabling to analyze performance of the manufactured centrifugal impeller, wherein the flow field of the centrifugal impeller at the impeller exit is dualized into a jet region flow field and a wake region flow field, by which each flow field thereof is sought and averaged to obtain the flow field.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
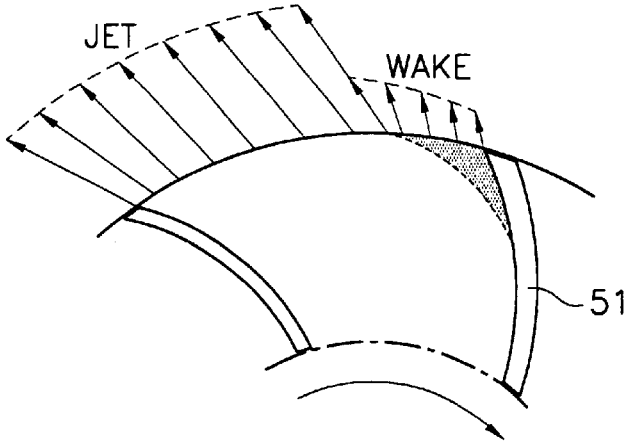
FIG. 1 is a constitutional drawing for illustrating fluid distribution at impeller exit according to performance analysis method of centrifugal impeller according to the present invention.
Figure 3:
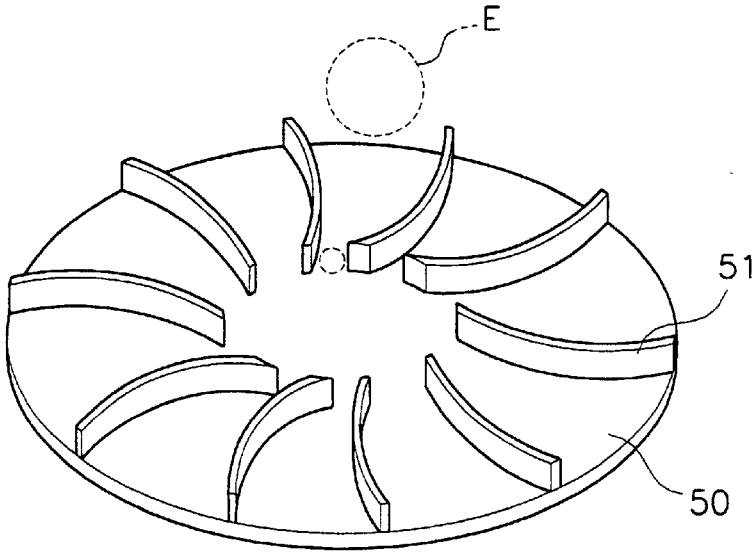
FIG.3 (prior art)
FIG. 3 is a schematic perspective view for illustrating a centrifugal impeller according to the prior art.

FIG. 1 is a constitutional drawing for illustrating a fluid distribution at an impeller exit according to performance analysis method of centrifugal impeller according to the present invention, where fluid at the exit side is divided at a blade exit of impeller rotating clockwise into a wake region generated at a longitudinal end approximate position of one blade and a jet region formed between the wake region and another approximate blade.

At this location, the wake region includes all the loss inside the impeller while the jet region belongs to a nearly isoentropic region at exit side flow. Of course, a slip coefficient and wake mass ratio change at the jet region and the wake region are considered, such that a slip coefficient of the jet region flow field and wake region flow field are obtained by the following Formulas 4 and 5.

Formula 4

$$\mu_j = 1 - f_1 \frac{A_{2j}}{r_2 b_2 Z},\ f_1 = 5.73 \times 10^{-6}(90 - \beta_{2b})^{5/2}$$

$\mu_j$: slip coefficient of jet region flow field $A_{2j}$: jet region area at impeller exit side $r_2$: radius of impeller $b_2$: exit width of impeller Z: number of blades at impeller exit side $\beta_{2b}$: impeller blade exit angle (axially interpreted)

Formula 5

$$\chi = 0.93\epsilon^2 + 0.07\epsilon$$

$\chi$: wake region flow field $\epsilon$: wake area ratio ($A_w/A_g$)

When variable values respectively obtained according to rotation of manufactured impeller are input in the above Formulas, a slip coefficient at the jet region and flow field of the wake region are obtained.

The slip coefficient of jet region and flow field of wake region thus obtained are averaged to obtain a flow field at the exit. The averaged flow field at the exit thus obtained is substituted for numerical formulas and variables of Formulas 1, 2 and 3 to thereby obtain characteristic numerical values of the exit flow angle, efficiency, total pressure ratio and the like.

Figure 2:
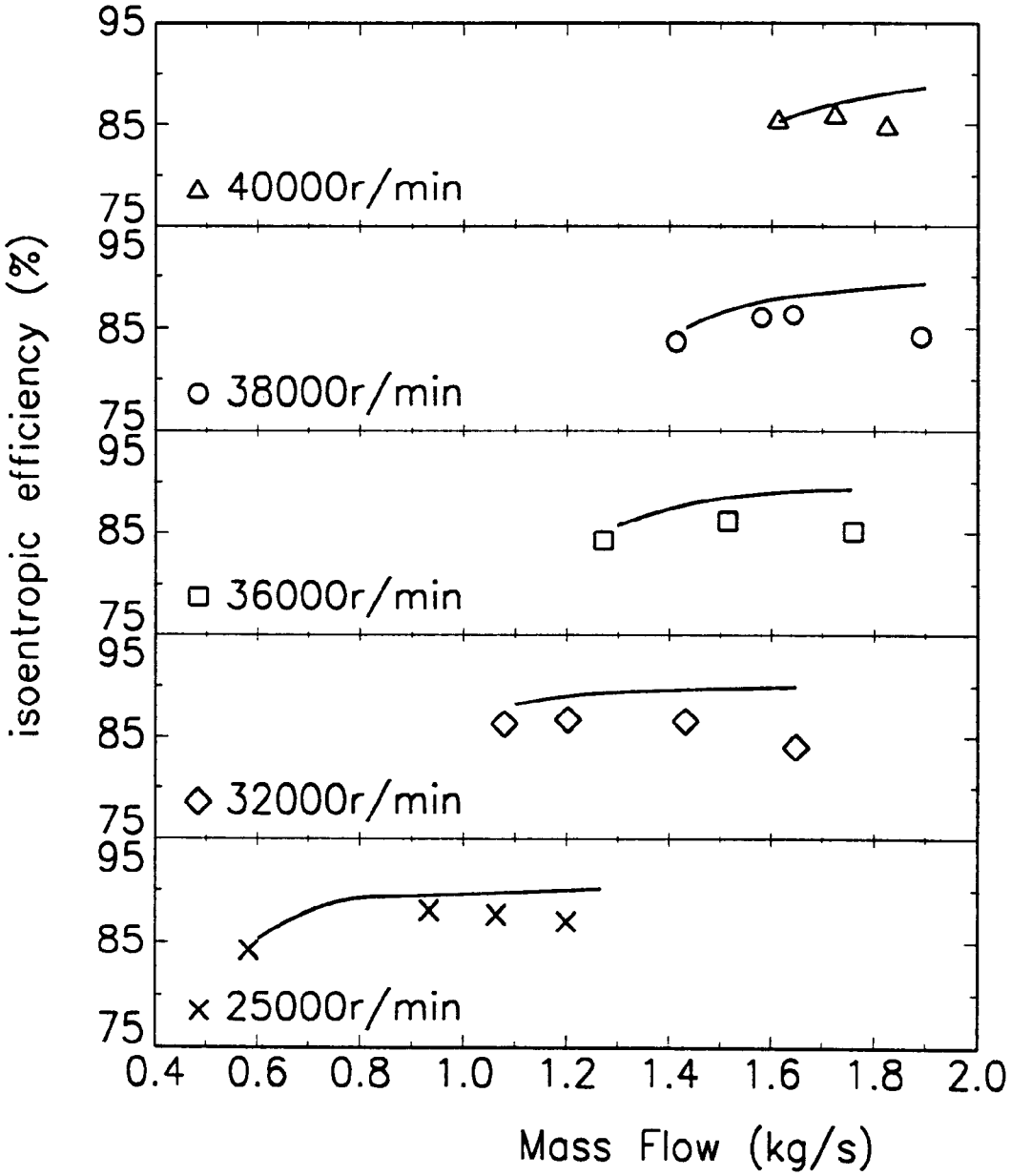
FIG. 2 is a graph for illustrating an isentropic state at a jet domain.

Although an entrophy increase in consideration of loss according to blade at the wake field has been considered in the above Formulas as illustrated in FIG. 2, only average flow at impeller entrance and exit may be calculated. Of course, flow field at the impeller entrance can be obtained by the same method. In other words, an impeller as a test object is activated to obtain a slip coefficient of jet region at entrance and flow field of wake region, both of which are averaged to obtain a flow field, which is then substituted for numerical formulas and variables of Formulas 1, 2 and 3 for obtainment of a plurality of characteristic numerical values according to performance analysis of impeller. This simplifies calculation of performance of centrifugal impeller.

As apparent from the foregoing, there is an advantage in the performance analysis method of centrifugal impeller according to the present invention thus described in that a jet region of isentropic region and a wake region including loss inside the impeller are dualized and averaged to calculate an exit flow field, thereby simplifying analysis of impeller performance.

What is claimed is:

1. A performance analysis method of centrifugal impeller, the method for measuring a flow field at an impeller exit to analyze an exit flow angle, total pressure ratio and efficiency, thereby enabling to analyze performance of the manufactured centrifugal impeller, wherein the flow field of the centrifugal impeller at the impeller exit is dualized into a jet region flow field and a wake region flow field, by which each flow field thereof is sought and averaged to obtain the flow field; and wherein the flow slip coefficient of the jet region and the wake region flow field in consideration of mass ratio change at wake region are obtained by Formula below:

$$\mu_j = 1 - f_1 \frac{A_{2j}}{r_2 b_2 Z},\ f_1 = 5.73 \times 10^{-6}(90 - \beta_{2b})^{5/2}$$

$\mu_j$: flow slip coefficient of jet region $A_{2j}$: jet region area at impeller exit $r_2$: radius of impeller $b_2$: exit width of impeller Z: number of blades at impeller exit $\beta_{2b}$: impeller blade exit angle (axially interpreted)

$$\chi = 0.93\epsilon^2 + 0.07\epsilon$$

$\chi$: wake region flow field $\epsilon$: wake area ratio ($A_w/A_g$).

2. The method as defined in claim 1, wherein a flow slip coefficient of jet region at the impeller exit is considered and a wake mass ratio change is considered at the wake region, to thereby obtain the flow field at the impeller exit.

* * * * *